US012429220B2

(12) United States Patent
Naik et al.

(10) Patent No.: US 12,429,220 B2
(45) Date of Patent: Sep. 30, 2025

(54) COMBUSTION SECTION WITH A PRIMARY COMBUSTOR AND A SET OF SECONDARY COMBUSTORS

(71) Applicant: GENERAL ELECTRIC COMPANY, Schenectady, NY (US)

(72) Inventors: Pradeep Naik, Bengaluru (IN); Clayton Stuart Cooper, Loveland, OH (US); Perumallu Vukanti, Bengaluru (IN); Michael A. Benjamin, West Chester, OH (US); Steven C. Vise, Loveland, OH (US); Sripathi Mohan, Bengaluru (IN); Ajoy Patra, Bengaluru (IN); Karthikeyan Sampath, Bengaluru (IN)

(73) Assignee: General Electric Company, Evendale, OH (US)

( * ) Notice: Subject to any disclaimer, the term of this patent is extended or adjusted under 35 U.S.C. 154(b) by 0 days.

(21) Appl. No.: 18/359,178

(22) Filed: Jul. 26, 2023

(65) Prior Publication Data

US 2024/0418369 A1 Dec. 19, 2024

(30) Foreign Application Priority Data

Jun. 14, 2023 (IN) ..... 202311040533

(51) Int. Cl.

| | |
|---|---|
| ***F23R 3/34*** | (2006.01) |
| ***F23R 3/00*** | (2006.01) |
| ***F23R 3/42*** | (2006.01) |

(52) U.S. Cl.

CPC ..... *F23R 3/002* (2013.01); *F23R 3/346* (2013.01); *F23R 3/425* (2013.01); *F23R 3/34* (2013.01); *F23R 3/343* (2013.01)

(58) Field of Classification Search

CPC .. F23R 3/34; F23R 3/346; F23R 3/343; F23R 3/002; F23R 3/425; F23R 2900/00015

See application file for complete search history.

(56) References Cited

U.S. PATENT DOCUMENTS

| | | | | |
|---|---|---|---|---|
| 2,607,191 A | | 8/1952 | Lee | |
| 4,168,609 A | * | 9/1979 | Greenberg | F23R 3/54 60/749 |
| 4,192,139 A | * | 3/1980 | Buchheim | F23R 3/30 60/750 |
| 4,420,929 A | * | 12/1983 | Jorgensen | F23R 3/346 60/737 |
| 4,893,475 A | | 1/1990 | Willis | |
| 5,121,597 A | | 6/1992 | Urushidani et al. | |
| 5,687,571 A | * | 11/1997 | Althaus | F23C 5/00 60/737 |
| 9,810,434 B2 | | 11/2017 | Wiebe | |

(Continued)

*Primary Examiner* — Thomas P Burke

(74) *Attorney, Agent, or Firm* — Carter, DeLuca & Farrell LLP

(57) ABSTRACT

A turbine engine with a compressor section, a combustion section, and a turbine section in serial flow arrangement along an engine centerline. The combustion section including a primary combustor liner having an inner liner and an outer liner. A dome wall and a dome inlet are located in the dome wall. At least one opening is located in the outer liner downstream from the dome inlet. A primary combustion chamber and a set of secondary combustors are fluidly coupled to the primary combustion chamber at the at least one opening.

20 Claims, 7 Drawing Sheets

(56) References Cited

U.S. PATENT DOCUMENTS

| | | | | |
|---|---|---|---|---|
| 10,060,629 | B2 * | 8/2018 | Kim | F23R 3/34 |
| 10,222,066 | B2 | 3/2019 | Chen et al. | |
| 10,436,450 | B2 | 10/2019 | Crawley et al. | |
| 12,173,898 | B1 * | 12/2024 | Naik | F23R 3/46 |
| 2004/0103663 | A1 * | 6/2004 | Haynes | F23R 3/58 60/737 |
| 2019/0017441 | A1 * | 1/2019 | Venkatesan | F23R 3/002 |
| 2019/0162414 | A1 | 5/2019 | Ogata et al. | |
| 2021/0071870 | A1 * | 3/2021 | Bulat | F23R 3/286 |
| 2022/0082258 | A1 | 3/2022 | Justice et al. | |
| 2022/0195938 | A1 * | 6/2022 | Ryon | F23R 3/16 |
| 2025/0075910 | A1 * | 3/2025 | Naik | F23R 3/42 |

* cited by examiner

COMBUSTION SECTION WITH A PRIMARY COMBUSTOR AND A SET OF SECONDARY COMBUSTORS

TECHNICAL FIELD

The present subject matter relates generally to a combustion section of a turbine engine, and more specifically to a combustion section with a primary combustor and a secondary combustor.

BACKGROUND

Turbine engines are driven by a flow of combustion gases passing through the engine to rotate a multitude of turbine blades, which, in turn, rotate a compressor to provide compressed air to the combustor for combustion. A combustor can be provided within the turbine engine and is fluidly coupled with a turbine into which the combusted gases flow.

The use of hydrocarbon fuels in the combustor of a turbine engine is known. Generally, air and fuel are fed to a combustion chamber, the air and fuel are mixed, and then the fuel is burned in the presence of the air to produce hot gas. The hot gas is then fed to a turbine where it cools and expands to produce power. By-products of the fuel combustion typically include environmentally unwanted by-products, such as nitrogen oxide and nitrogen dioxide (collectively called $NO_x$), carbon monoxide (CO), unburned hydrocarbons (UHC) (e.g., methane and volatile organic compounds that contribute to the formation of atmospheric ozone), and other oxides, including oxides of sulfur (e.g., $SO_2$ and $SO_3$).

Varieties of fuel for use in combustion turbine engines are being explored. Hydrogen or hydrogen mixed with another element or compound can be used for combustion, however hydrogen or a hydrogen mixed fuel can result in a higher flame temperature than traditional fuels. That is, hydrogen or a hydrogen mixed fuel typically has a wider flammable range and a faster burning velocity than traditional fuels such as petroleum-based fuels, or petroleum and synthetic fuel blends.

Standards stemming from air pollution concerns worldwide regulate the emission of $NO_x$, UHC, and CO generated as a result of the turbine engine operation. In particular, $NO_x$ is formed within the combustor as a result of high combustor flame temperatures during operation. It is desirable to decrease $NO_x$ emissions while still maintaining desirable efficiencies by regulating the profile and or pattern within the combustor.

DETAILED DESCRIPTION

Figure 1:
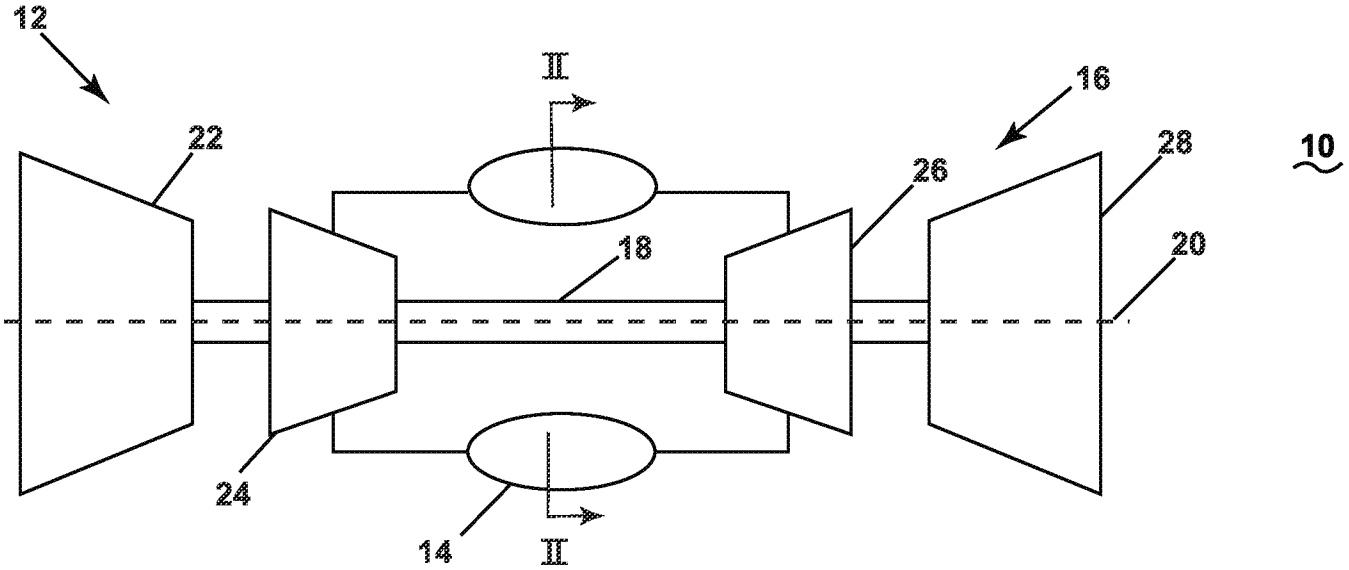
FIG. 1 is a schematic of a turbine engine.

Aspects of the disclosure described herein are directed to a combustion section, and in particular a combustion section with a primary combustor and a secondary combustor. For purposes of illustration, the present disclosure will be described with respect to a turbine engine. It will be understood, however, that aspects of the disclosure described herein are not so limited and that a combustion section as described herein can be implemented in engines, including but not limited to turbojet, turboprop, turboshaft, and turbofan engines. Aspects of the disclosure discussed herein may have general applicability within non-aircraft engines having a combustor, such as other mobile applications and non-mobile industrial, commercial, and residential applications.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

As used herein, the terms "first", "second", and "third" may be used interchangeably to distinguish one component from another and are not intended to signify location or importance of the individual components.

The terms "forward" and "aft" refer to relative positions within a gas turbine engine or vehicle, and refer to the normal operational attitude of the gas turbine engine or vehicle. For example, with regard to a gas turbine engine, forward refers to a position closer to an engine inlet and aft refers to a position closer to an engine nozzle or exhaust.

As used herein, the term "upstream" refers to a direction that is opposite the fluid flow direction, and the term "downstream" refers to a direction that is in the same direction as the fluid flow. The term "fore" or "forward" means in front of something and "aft" or "rearward" means behind something. For example, when used in terms of fluid flow, fore/forward can mean upstream and aft/rearward can mean downstream.

The term "fluid" may be a gas or a liquid. The terms "fluidly couples" and "fluidly coupled" mean that a fluid is capable of making the connection between the areas specified.

Additionally, as used herein, the terms "radial" or "radially" refer to a direction away from a common center. For example, in the overall context of a turbine engine, radial refers to a direction along a ray extending between a center longitudinal axis of the engine and an outer engine circumference.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) may be used for identification purposes to aid the reader's understanding of the present disclosure, and do not create limitations, particularly as to the position, orientation, or use of aspects of the disclosure described herein. Connection references (e.g., attached, coupled, connected, and joined) may be used and are to be construed broadly and can include intermediate structural elements between a collection of elements and relative movement between elements unless otherwise indicated. As such, connection references do not necessarily infer that two elements are directly connected and in fixed relation to one another. The exemplary drawings are for purposes of illustration only the dimensions, positions, order and relative sizes reflected in the drawings attached hereto can vary.

The singular forms "a", "an", and "the" include plural references unless the context clearly dictates otherwise. Furthermore, as used herein, the term "set" or a "set" of elements can be any number of elements, including only one.

Approximating language, as used herein throughout the specification and claims, is applied to modify any quantitative representation that could permissibly vary without resulting in a change in the basic function to which it is related. Accordingly, a value modified by a term or terms, such as "about", "approximately", "generally", and "substantially", are not to be limited to the precise value specified. In at least some instances, the approximating language may correspond to the precision of an instrument for measuring the value, or the precision of the methods or machines for constructing or manufacturing the components and/or systems. In at least some instances, the approximating language may correspond to the precision of an instrument for measuring the value, or the precision of the methods or machines for constructing or manufacturing the components and/or systems. For example, the approximating language may refer to being within a 1, 2, 4, 5, 10, 15, or 20 percent margin in either individual values, range(s) of values and/or endpoints defining range(s) of values. Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

FIG. 1 is a schematic view of a turbine engine 10. As a non-limiting example, the turbine engine 10 can be used within an aircraft. The turbine engine 10 can include, at least, a compressor section 12, a combustion section 14, and a turbine section 16. A drive shaft 18 rotationally couples the compressor section 12 and the turbine section 16, such that rotation of one affects the rotation of the other, and defines a rotational axis or centerline 20 for the turbine engine 10.

The compressor section 12 can include a low-pressure (LP) compressor 22, and a high-pressure (HP) compressor 24 serially fluidly coupled to one another. The turbine section 16 can include an LP turbine 28, and an HP turbine 26 serially fluidly coupled to one another. The drive shaft 18 can operatively couple the LP compressor 22, the HP compressor 24, the LP turbine 28 and the HP turbine 26 together. Alternatively, the drive shaft 18 can include an LP drive shaft (not illustrated) and an HP drive shaft (not illustrated). The LP drive shaft can couple the LP compressor 22 to the LP turbine 28, and the HP drive shaft can couple the HP compressor 24 to the HP turbine 26. An LP spool can be defined as the combination of the LP compressor 22, the LP turbine 28, and the LP drive shaft such that the rotation of the LP turbine 28 can apply a driving force to the LP drive shaft, which in turn can rotate the LP compressor 22. An HP spool can be defined as the combination of the HP compressor 24, the HP turbine 26, and the HP drive shaft such that the rotation of the HP turbine 26 can apply a driving force to the HP drive shaft which in turn can rotate the HP compressor 24.

The compressor section 12 can include a plurality of axially spaced stages. Each stage includes a set of circumferentially-spaced rotating blades and a set of circumferentially-spaced stationary vanes. The compressor blades for a stage of the compressor section 12 can be mounted to a disk, which is mounted to the drive shaft 18. Each set of blades for a given stage can have its own disk. The vanes of the compressor section 12 can be mounted to a casing which can extend circumferentially about the turbine engine 10. It will be appreciated that the representation of the compressor section 12 is merely schematic and that there can be any number of stages. Further, it is contemplated, that there can be any other number of components within the compressor section 12.

Similar to the compressor section 12, the turbine section 16 can include a plurality of axially spaced stages, with each stage having a set of circumferentially-spaced, rotating blades and a set of circumferentially-spaced, stationary vanes. The turbine blades for a stage of the turbine section 16 can be mounted to a disk which is mounted to the drive shaft 18. Each set of blades for a given stage can have its own disk. The vanes of the turbine section 16 can be mounted to the casing in a circumferential manner. It is noted that there can be any number of blades, vanes and turbine stages as the illustrated turbine section is merely a schematic representation. Further, it is contemplated, that there can be any other number of components within the turbine section 16.

The combustion section 14 can be provided serially between the compressor section 12 and the turbine section 16. The combustion section 14 can be fluidly coupled to at least a portion of the compressor section 12 and the turbine section 16 such that the combustion section 14 at least partially fluidly couples the compressor section 12 to the turbine section 16. As a non-limiting example, the combustion section 14 can be fluidly coupled to the HP compressor 24 at an upstream end of the combustion section 14 and to the HP turbine 26 at a downstream end of the combustion section 14.

During operation of the turbine engine 10, ambient or atmospheric air is drawn into the compressor section 12 via a fan (not illustrated) upstream of the compressor section 12, where the air is compressed defining a pressurized air. The pressurized air can then flow into the combustion section 14 where the pressurized air is mixed with fuel and ignited, thereby generating combustion gases. Some work is extracted from these combustion gases by the HP turbine 26, which drives the HP compressor 24. The combustion gases are discharged into the LP turbine 28, which extracts additional work to drive the LP compressor 22, and the exhaust gas is ultimately discharged from the turbine engine 10 via an exhaust section (not illustrated) downstream of the turbine section 16. The driving of the LP turbine 28 drives the LP spool to rotate the fan (not illustrated) and the LP compressor 22. The pressurized airflow and the combustion gases can together define a working airflow that flows through the fan, compressor section 12, combustion section 14, and turbine section 16 of the turbine engine 10.

Figure 2:
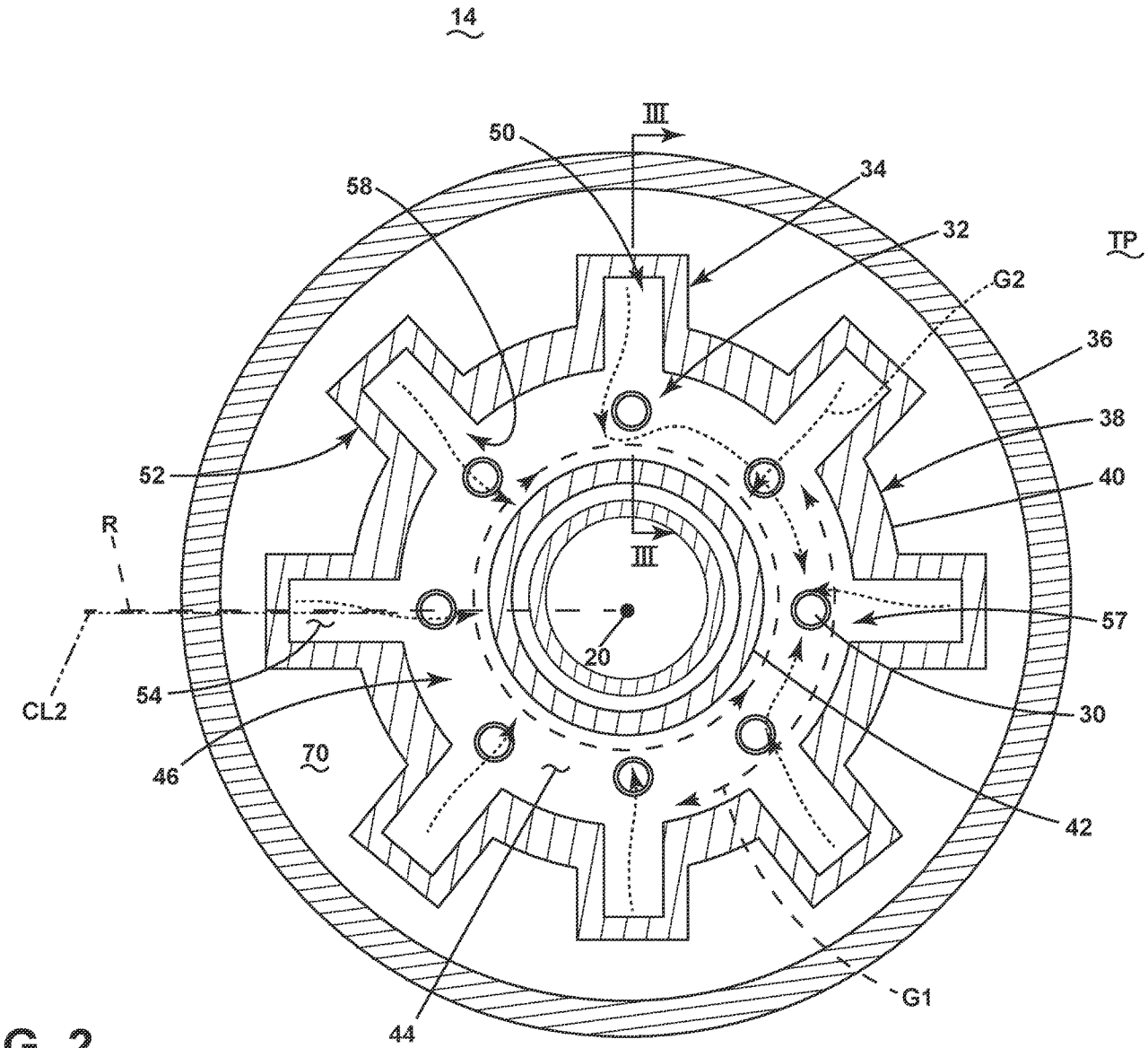
FIG. 2 depicts a cross-sectional view along line II-II of FIG. 1 of a combustion section of the turbine engine with a set of secondary combustors

FIG. 2 depicts a cross-sectional view of the combustion section 14 along line II-II of FIG. 1 defining a transverse plane (denoted "TP"). The combustion section 14 can include an annular arrangement of primary fuel injectors 30 disposed around the centerline 20 of the turbine engine 10. Each of the primary fuel injectors 30 are fluidly coupled to a primary combustor 32. It should be appreciated that the annular arrangement of fuel injectors can be one or multiple fuel injectors and one or more of the primary fuel injectors 30 can have different characteristics. The primary combustor 32 can have a can, can-annular, or annular arrangement depending on the type of engine in which the primary combustor 32 is located. In a non-limiting example, an annular arrangement is illustrated and disposed within a casing 36. The primary combustor 32 is defined by a primary combustor liner 38 including an outer liner 40 and an inner liner 42 concentric with respect to each other and annular about the centerline 20. A dome wall 44 together with the primary combustor liner 38 define a primary combustion chamber 46 annular about the centerline 20.

The combustion section 14 further includes a circumferential arrangement of mini combustors 34 defining a set of secondary combustors 50. As used herein "mini" means that the component referenced with the term mini is smaller than the corresponding like component without the term mini (i.e., the mini combustor 34 is smaller than the primary combustor 32). Each mini combustor 34 in the set of secondary combustors 50 is defined by a secondary combustor liner 52 extending generally perpendicular from the primary combustor liner 38. The secondary combustor liner 52 defines at least a portion of a secondary combustion chamber 54 circumferentially spaced about the centerline 20. The set of secondary combustors 50 is fluidly coupled to the primary combustor 32 by at least one opening 57 extending through the outer liner 40. More specifically, the secondary combustion chamber 54 terminates at the at least one opening 57 to define a secondary combustor outlet 58. In a non-limiting example, each secondary combustion chamber 54 in the set of secondary combustors 50 is radially aligned with the primary fuel injectors 30. The secondary combustor chamber 54 can define a secondary centerline (denoted "CL2") extending toward the secondary combustor outlet 58. A radial line (denoted "R") extends from the centerline 20 and is aligned with the secondary centerline CL2 in the transverse plane TP.

The primary combustor 32 produces primary exhaust gasses (denoted "G1") in the primary combustion chamber 46. The set of secondary combustors 50 produce secondary exhaust gasses (denoted "G2") in the secondary combustion chamber 54 that flow into the primary combustion chamber 46. The secondary exhaust gasses G2 circulate in the primary combustion chamber 46 starving $O_2$ levels and reducing temperatures in the primary combustion chamber 46. This results in a reduction of $NO_x$ emissions.

Figure 3:
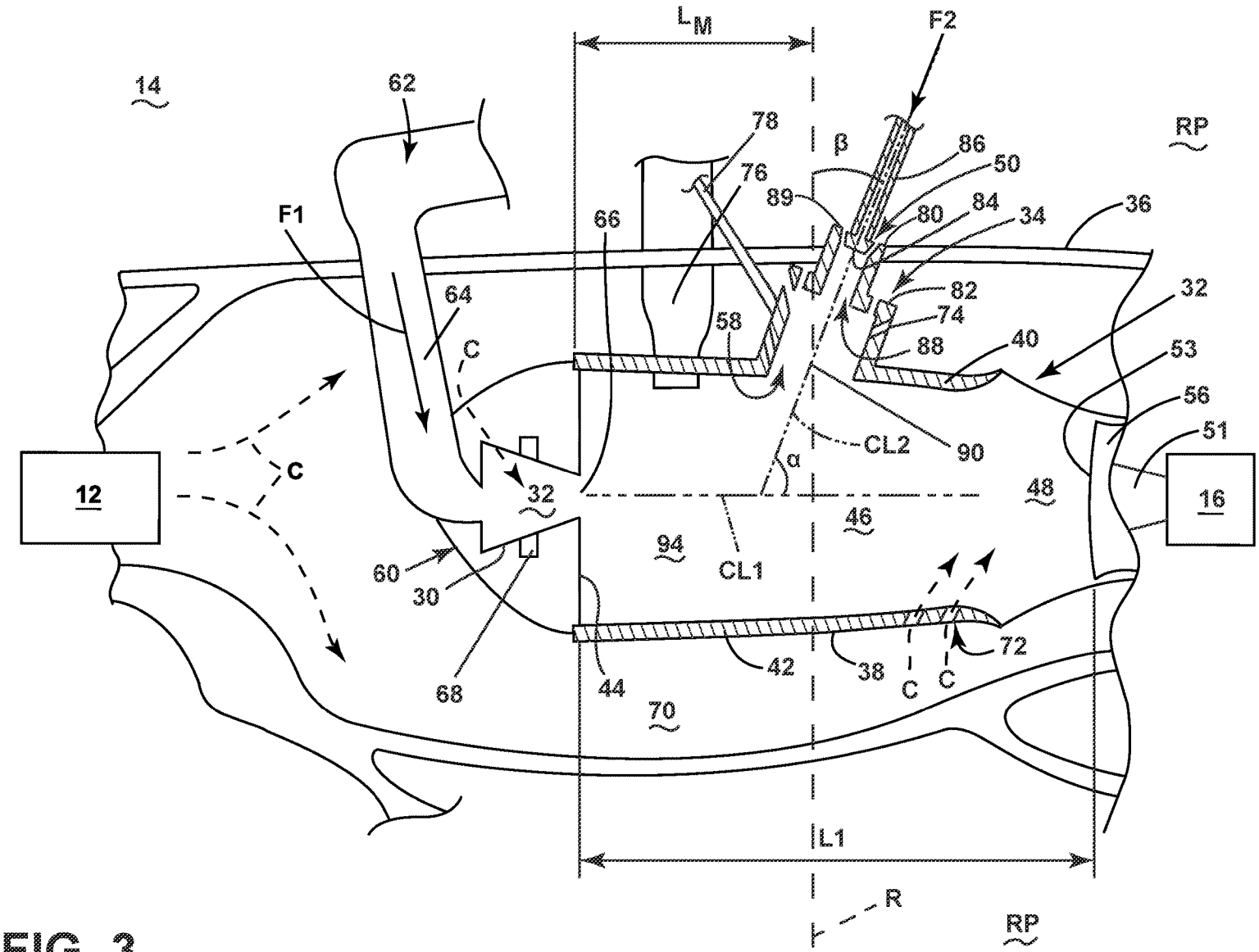
FIG. 3 is a cross-sectional view taken along line III-III of FIG. 2 of a combustor in the combustion section and a mini combustor from the set of secondary combustors.

FIG. 3 depicts a cross-sectional view taken along line III-III of FIG. 2 illustrating the combustion section 14 as viewed in a radial plane (denoted "RP"). The primary combustor 32 extends between the dome wall 44 and a primary combustor outlet 48 at a nozzle assembly 56 defining an inlet 51 to the turbine section 16. A dome assembly 60 includes the dome wall 44 and houses the primary fuel injector 30. The primary fuel injector 30 can be fluidly coupled to a fuel inlet 62 via a fuel passageway 64 that can be adapted to receive a primary flow of fuel (denoted "F1"). The primary fuel injector 30 can terminate in a fuel outlet also referred to herein as a dome inlet 66. In some implementations the primary fuel injector 30 can include a swirler 68 circumferentially arranged about the dome inlet 66. The at least one opening 57 is located downstream from the dome inlet 66.

A compressed air passageway 70 can surround the primary combustor 32 and be at least partially defined by the casing 36. Compressed air (denoted "C") can be provided to the combustion section 14 from the compressor section 12 via the compressed air passageway 70. A primary set of dilution openings 72 can be provided in the primary combustor liner 38 at a location downstream from the mini combustor 34 for connecting the compressed air passageway 70 and the primary combustion chamber 46. The primary combustor liner 38 is free of dilution openings at any location upstream from the mini combustor 34. A secondary set of dilution openings 74 can be provided in the secondary combustor liner 52 for connecting the compressed air passageway 70 and the secondary combustion chamber 54. By way of non-limiting example, when the primary combustor 32 is a rich burn system, the secondary set of dilution openings 74 are at an aft location of the mini combustor 34 for trimming a combustor exit temperature profile and pattern factor associated with the mini combustor 34 and primary combustor 32. A primary ignitor 76 can be fluidly coupled to the primary combustion chamber 46. A secondary ignitor 78 can be fluidly coupled to the secondary combustion chamber 54. The compressed air C can be split between the primary combustor 32 and the set of secondary combustors 50 such that the primary combustor 32 receives 60% to 90% of the compressed air C from the compressor section 12 while the set of secondary combustors 50 receives between 10% and 40%.

Each mini combustor 34 includes a mini dome assembly 80 including a mini dome wall 82 and housing a mini fuel injector 84. The mini fuel injector 84 can be fluidly coupled to a secondary fuel passageway 86 that can be adapted to receive a secondary flow of fuel (denoted "F2"). The mini fuel injector 84 terminates in a secondary fuel outlet also referred to herein as a mini dome inlet 88 open to the secondary combustion chamber 54. In some implementations the mini fuel injector 84 can include a low swirl number swirler 89, i.e., with a number less than 1 and having a low tangential velocity, circumferentially arranged about the mini dome inlet 88. It is further contemplated that the set of secondary combustors do not include a swirler, but can have non swirling air passages.

The dome inlet 66 defines a primary centerline (denoted "CL1"). A primary combustor length (denoted "L1") is measured parallel to the primary centerline CL1 between the dome wall 44 and a leading edge 53 of the nozzle assembly 56. The mini dome inlet 88 can define the secondary centerline CL2 extending toward the secondary combustor outlet 58. The secondary combustor outlet 58 intersects the secondary centerline CL2 to define a geometric center 90 of the secondary combustor outlet 58. A main combustion zone 94 is defined as the volume between the dome inlet 66 and the geometric center 90. A main combustion length (denoted "$L_M$") is measured parallel to the primary centerline CL1 from the dome wall 44 to the geometric center 90. The main combustion length LM is from 5% to 90% of the primary combustor length L1. The combustion length Ly can be 5% to 50% of the primary combustor length L1. The main combustion zone 94 can have a combustion residence time that ranges from 1.0 ms to 12 ms, inclusive of endpoints. The secondary combustion chamber can have a combustion residence time that ranges from 0.1 ms to 8 ms, inclusive of endpoints. The total combustion residence time for the combustion section 14 can range from 1.1 ms to 20 ms, inclusive of endpoints.

The primary centerline CL1 and the secondary centerline CL2 intersect to define a primary combustor angle (denoted "$\alpha$") in the radial plane RP. The set of secondary combustors 50 can be angled toward the dome inlet 66 such that the primary combustor angle $\alpha$ is 90° or less. The set of secondary combustors 50 when angled toward the dome inlet 66 have a primary combustor angle $\alpha$ that can vary from 25° to 90°. It is further contemplated that the set of secondary combustors 50 can be angled away from the dome inlet 66 such that the primary combustor angle α is greater than 90°. The set of secondary combustors 50 when angled away from the dome inlet 66 have a primary combustor angle α that can vary from 90° to 165°. It should be understood that the set of secondary combustors 50 can include at least one mini combustor 34 angled toward the dome inlet 66 and another at least one mini combustor 34 angled away from the dome inlet 66, or any combination thereof. The radial line R intersects the geometric center 90 and the secondary centerline CL2 to define a second combustor angle (denoted "β") in the radial plane RP. Geometrically the primary combustor angle α and the second combustor angle β are complementary angles.

Figure 4:
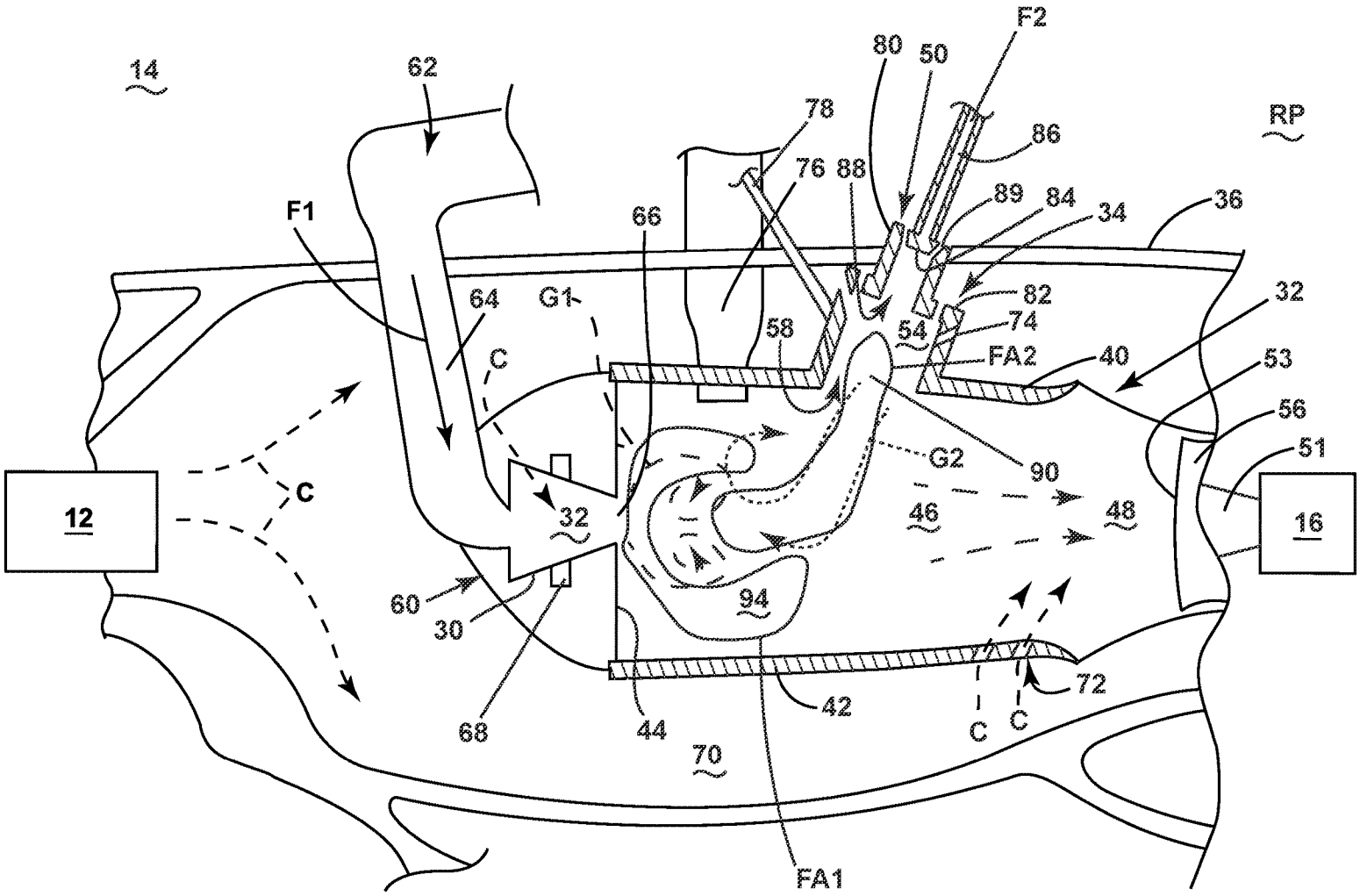
FIG. 4 is the same cross-sectional view of FIG. 3 illustrating an interaction of a primary fuel/air mixture and primary exhaust gasses and a secondary fuel/air mixture and secondary exhaust gasses.

Referring to FIG. 4, during operation, compressed air C can be fed into the primary fuel injector 30 and mixed with the primary flow of fuel F1 to define a primary fuel/air mixture (denoted "FA1"). The primary fuel injector 30 along with the primary ignitor 76 define a primary burn system having a primary flame. The primary fuel injector 30 can dispense a primary fuel/air mixture FA1 that is premixed or partially premixed. Further the flow of fuel F1 can be a diffusion fuel free of an air mixture prior to entering the primary combustion chamber 46. The primary burn system can be a rich burn system or a lean burn system. A rich burn combustion system includes a fuel/air ratio above the stoichiometric fuel/air ratio whereas a lean burn combustion system includes a fuel/air ratio below the stoichiometric fuel/air ratio. A rich burn system for the primary combustor 32 will create a higher temperature within the primary combustion chamber 46 providing flame stability to the overall combustion system. When combined with a lean burn system for the set of secondary combustors 50, $NO_x$ is reduced from the secondary combustion chamber 54. Similarly, the primary combustor 32 can be a lean burn system for lower $NO_x$ from the primary combustion chamber 46 with the set of secondary combustors 50 having a rich burn system for providing flame stability to the primary combustor 32 and the entire combustion system. Further both the primary combustor 32 and the set of secondary combustors 50 can be a rich burn system or a lean burn system. With both having lean burn systems, the $NO_x$ emissions is greatly reduced. However, at least one or more of the primary fuel injectors 30 or mini fuel injectors 84 will need to be fuel rich to provide flame stability. Likewise, both the primary combustor 32 and the set of secondary combustors 50 can have rich burn systems where lowering $NO_x$ in this system is achieved by staging fuel and starvation of $O_2$ in the primary combustor 32 from product released from the set of secondary combustors 50 that produces lower $NO_x$.

Compressed air C can be fed into the mini fuel injector 84 and mixed with the secondary flow of fuel F2 to define a secondary fuel/air mixture (denoted "FA2"). The mini fuel injector 84 along with the secondary ignitor 78 can define a mini burn system including a secondary flame that can be premixed, partially premixed, or diffusion. The mini burn system can be a rich burn system or a lean burn system. Fuel provided to the primary fuel injectors 30 and the mini fuel injectors 84 can include jet fuel natural gas or a more reacting fuel like $H_2$ and blends of $H_2$. In some implementations, the turbine engine 10 can be started on conventional fuel using the set of secondary combustors 50 where the secondary exhaust gasses G2 is propagated towards the primary combustion chamber 46 which can be fueled using conventional fuel or $H_2$ fuel.

When the secondary exhaust gasses G2 are directed towards the primary combustion chamber 46, the primary exhaust gasses G1 and the secondary exhaust gasses G2 mix which reduces $O_2$ levels in the primary combustion chamber 46 that reduces $NO_x$ emissions. Fuel staging between the primary combustion chamber 46 and the secondary combustion chamber 54 reduces the fuel/air ratio in these stages of the combustion section 14 which contributes to a further reduction in temperature and $NO_x$ emissions. In comparison a single staged combustor will have relatively higher fuel/air ratios and higher temperatures which leads to higher $NO_x$ emissions. The process of directing the secondary exhaust gasses G2 from the mini combustor 34 into the primary combustion chamber 46 at the primary combustor angle α improves turbulence levels. Turbulence helps to thoroughly mix the primary and secondary exhaust gasses G1, G2 which improves a uniform temperature distribution, again resulting in a reduction in $NO_x$.

Further, the arrangement described herein improves the primary combustor 32 exit temperature profile and pattern factor. Mixing the products of combustion produced by the set of secondary combustors 50 with those of the primary combustor 32 helps to improve temperature distribution within the primary combustion chamber 46 due to higher turbulence created by the products impinging on each other. An amount of secondary exhaust gasses G2 re-circulating in primary or main combustor chamber 94 can range from 0.1% to 100% to cut down $NO_x$ emission.

Figure 5:
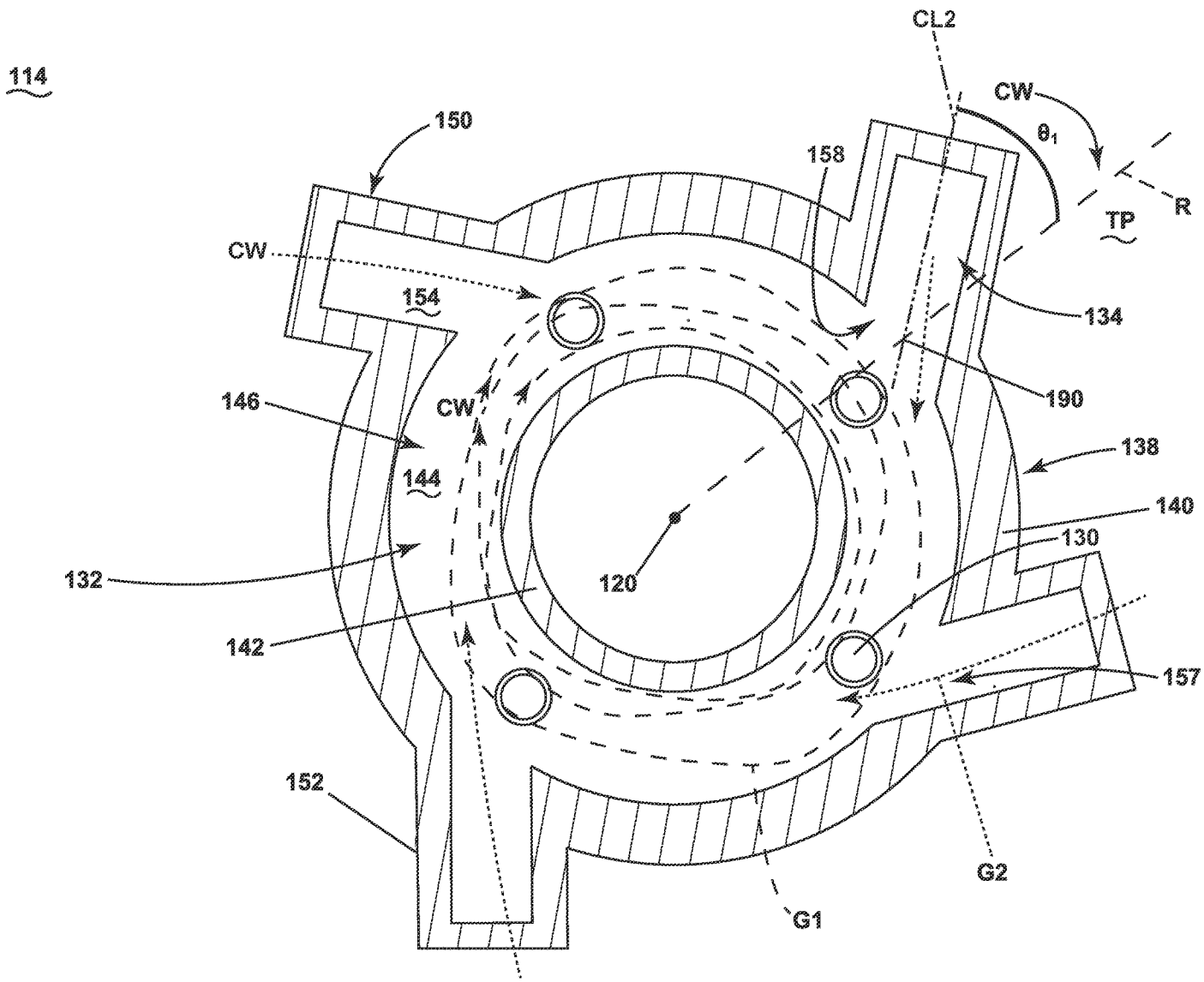
FIG. 5 is a variation of the combustion section from FIG. 2 according to an aspect of the disclosure herein.

FIG. 5 illustrates a combustion section 114 with a set of secondary combustors 150 oriented circumferentially about a primary combustor 132 according to another aspect of the disclosure herein. The combustion section 114 is similar to the combustion section 14 of FIGS. 2-4; therefore, like parts will be identified with like numerals increased by 100, with it being understood that the description of the like parts of the combustion section 14 applies to the combustion section 114, except where noted. Further, while four mini combustors 134 are illustrated as the set of secondary combustors 150, it should be understood that any number of mini combustors 134 is contemplated. Likewise, any number of associated primary fuel injectors 130 and mini fuel injectors (not shown) is contemplated including that they can be the same or different amounts and that the figures depicted herein are non-limiting examples.

The combustion section 114 includes an annular arrangement of the primary fuel injectors 130 disposed around an engine centerline 120. Each of the primary fuel injectors 130 are fluidly coupled to the primary combustor 132. The primary combustor 132 is defined by a primary combustor liner 138 including an outer liner 140 and an inner liner 142 concentric with respect to each other and annular about the engine centerline 120. A dome wall 144 together with the primary combustor liner 138 define a primary combustion chamber 146 annular about the engine centerline 120.

The combustion section 114 further includes a circumferential arrangement of the mini combustors 134 defining the set of secondary combustors 150. Each mini combustor 134 in the set of secondary combustors 150 is defined by a secondary combustor liner 152 extending generally perpendicular from the primary combustor liner 138. The secondary combustor liner 152 defines at least a portion of a secondary combustion chamber 154 circumferentially spaced about the engine centerline 120. The set of secondary combustors 150 is fluidly coupled to the primary combustor 132 by at least one opening 157 extending through the outer liner 140. More specifically, the secondary combustion chamber 154 terminates at the at least one opening 157 to define a secondary combustor outlet 158. In a non-limiting example, each secondary combustion chamber 154 in the set of secondary combustors 150 is aligned with the primary fuel injectors 130.

A radial line R intersects with the secondary centerline CL2 at a geometric center 190 of the secondary combustor outlet 158. The radial line R forms an orientation angle with the secondary centerline CL2, more specifically a first orientation angle $\theta_1$ with the secondary centerline CL2 in the transverse plane TP. The first orientation angle $\theta_1$ is measured from the secondary centerline CL2 in a clockwise direction (denoted "CW") to the radial line R.

The primary combustor 132 produces primary exhaust gasses G1 in the primary combustion chamber 146 that recirculate in a first direction produced by the swirler 68, by way of non-limiting example a clockwise direction (denoted "CW"). The set of secondary combustors 50 produce secondary exhaust gasses G2 in the secondary combustion chamber 54 that flow into the primary combustion chamber 146 and recirculate in the same direction as the first direction, in the clockwise direction CW. The secondary exhaust gasses G2 circulate in the primary combustion chamber 146 starving $O_2$ levels and reducing temperatures in the primary combustion chamber 146. This results in a reduction of $NO_x$ emissions. In another embodiment, it is further contemplated that the primary exhaust gasses G1 can be in a counterclockwise direction (denoted "CCW") (FIG. 6) and the secondary exhaust gasses G2 are in the clockwise CW direction.

Figure 6:
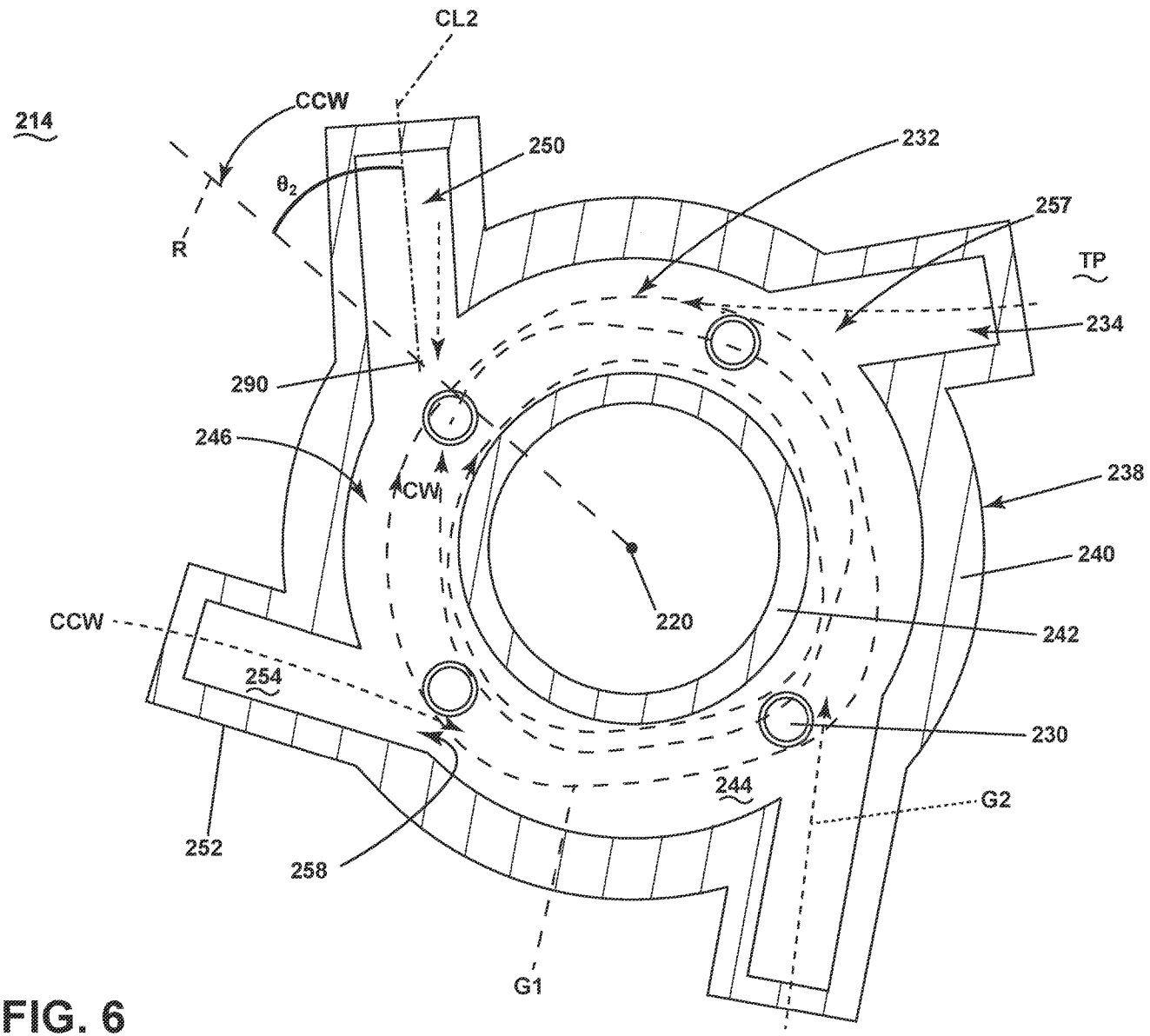
FIG. 6 is a variation of the combustion section from FIG. 2 according to another aspect of the disclosure herein.

FIG. 6 illustrates a combustion section 214 with a set of secondary combustors 250 oriented circumferentially about a primary combustor 232 according to another aspect of the disclosure herein. The combustion section 214 is similar to the combustion section 14 of FIGS. 2-4; therefore, like parts will be identified with like numerals increased by 200, with it being understood that the description of the like parts of the combustion section 14 applies to the combustion section 214, except where noted. Further, while four mini combustors 234 are illustrated as the set of secondary combustors 250, it should be understood that any number of mini combustors 234 is contemplated. Likewise, any number of the associated primary fuel injectors 230 and mini fuel injectors (not shown) is contemplated including that they can be the same or different amounts and that the figures depicted herein are non-limiting examples.

The combustion section 214 includes an annular arrangement of the primary fuel injectors 230 disposed around an engine centerline 220. Each of the primary fuel injectors 230 are fluidly coupled to the primary combustor 232. The primary combustor 232 is defined by a primary combustor liner 238 including an outer liner 240 and an inner liner 242 concentric with respect to each other and annular about the engine centerline 120. A dome wall 244 together with the primary combustor liner 238 define a primary combustion chamber 146 annular about the engine centerline 220.

The combustion section 214 further includes a circumferential arrangement of the mini combustors 234 defining the set of secondary combustors 250. Each mini combustor 234 in the set of secondary combustors 250 is defined by a secondary combustor liner 252 extending generally perpendicular from the primary combustor liner 238. The secondary combustor liner 252 defines at least a portion of a secondary combustion chamber 254 circumferentially spaced about the engine centerline 220. The set of secondary combustors 250 is fluidly coupled to the primary combustor 232 by at least one opening 257 extending through the outer liner 240. More specifically, the secondary combustion chamber 254 terminates at the at least one opening 257 to define a secondary combustor outlet 258. In a non-limiting example, each secondary combustion chamber 254 in the set of secondary combustors 250 is aligned with the primary fuel injectors 230.

A radial line R intersects with the secondary centerline CL2 at a geometric center 290 of the secondary combustor outlet 258. The radial line R forms a second orientation angle $\theta_2$ with the secondary centerline CL2 in the transverse plane TP. The first orientation angles $\theta_1$ (FIG. 5) and the second orientation angle $\theta_2$ can be the same value, or different values. The second orientation angle $\theta_2$ is measured from the secondary centerline CL2 in the counterclockwise direction CW to the radial line R.

The primary combustor 232 produces primary exhaust gasses G1 in the primary combustion chamber 246 that recirculates in the first direction, by way of non-limiting example the clockwise direction CW. The set of secondary combustors 250 produce secondary exhaust gasses G2 in the secondary combustion chamber 254 that flow into the primary combustion chamber 246 and recirculate in an opposite direction as the first direction, by way of non-limiting example the counterclockwise direction CCW. The secondary exhaust gasses G2 circulate in the primary combustion chamber 246 starving $O_2$ levels and reducing temperatures in the primary combustion chamber 246. This results in a reduction of $NO_x$ emissions.

Figure 7:
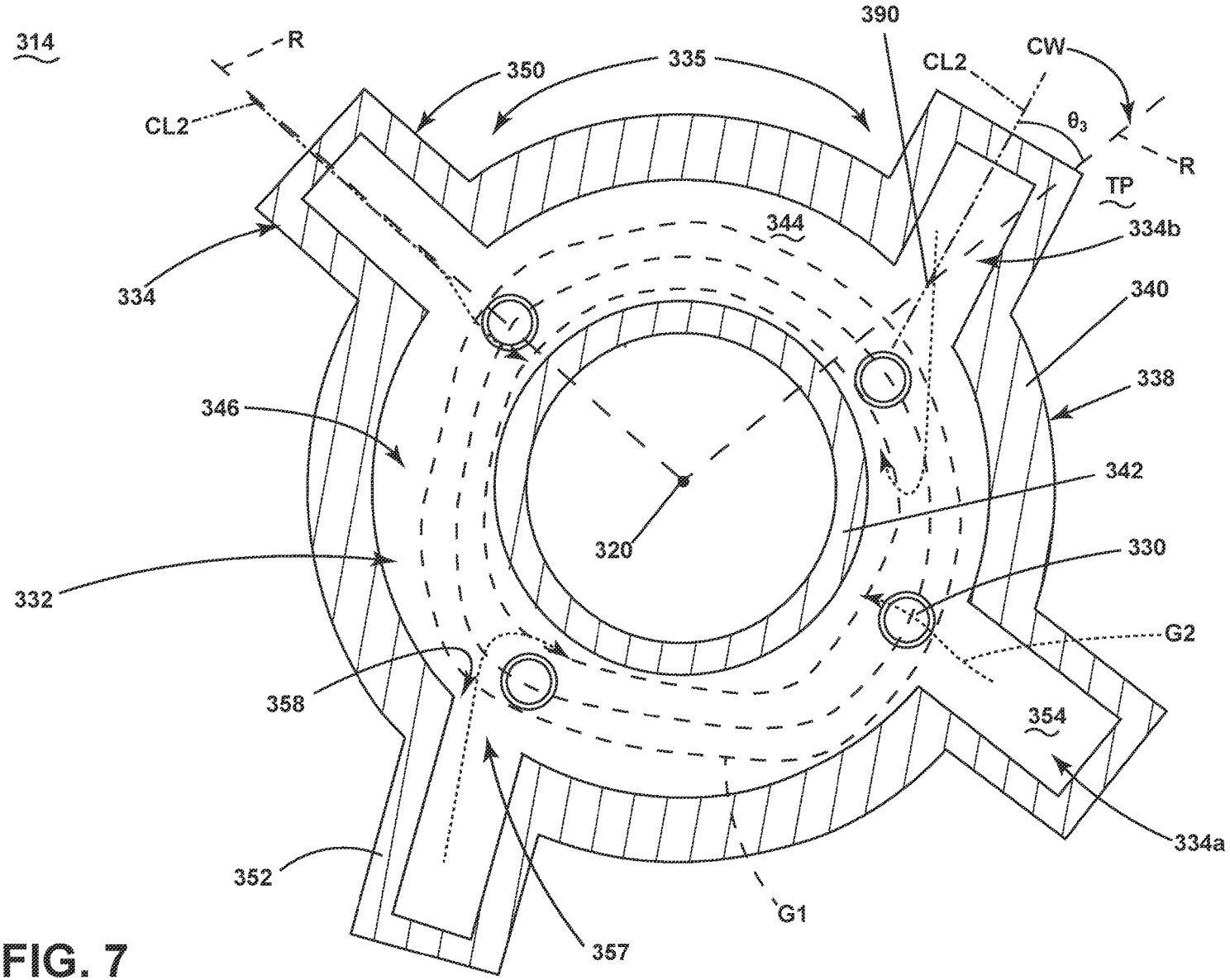
FIG. 7 is a variation of the combustion section from FIG. 2 according to yet another aspect of the disclosure herein.

FIG. 7 illustrates a combustion section 314 with a set of secondary combustors 350 oriented circumferentially about a primary combustor 332 according to another aspect of the disclosure herein. The combustion section 314 is a combination of the combustion section 14 of FIGS. 2-4 and the combustion section 114 of FIG. 5. Like parts will be identified with like numerals increased by 300 with respect to combustion section 14. It should be understood that the description of the like parts of the combustion section 14 applies to the combustion section 314, except where noted. Further, while four mini combustors 334 are illustrated as the set of secondary combustors 350, it should be understood that any number of mini combustors 334 is contemplated.

The combustion section 314 includes an annular arrangement of primary fuel injectors 330 disposed around an engine centerline 320. Each of the primary fuel injectors 330 are fluidly coupled to the primary combustor 332. The primary combustor 332 is defined by a primary combustor liner 338 including an outer liner 340 and an inner liner 342 concentric with respect to each other and annular about the engine centerline 320. A dome wall 344 together with the primary combustor liner 338 define a primary combustion chamber 346 annular about the engine centerline 320.

Further illustrated is a secondary combustor line 352, at least one opening 357, secondary combustor outlet 358, and geometric center 390 of the secondary combustor outlet 358. The combustion section 314 further includes the plurality of mini combustors 334, and more particularly, a circumferential arrangement of differently oriented mini combustors 335. The differently oriented mini combustors 335 can define the set of secondary combustors 350. By way of non-limiting example, the differently oriented mini combustors 335 can include a first plurality of mini combustors **334*a* similarly angled to the mini combustors 34 of FIG. 2, where a radial line R extends from the centerline 320 and is aligned with a secondary centerline CL2 in the transverse plane TP. The differently oriented mini combustors 335 can further include a second plurality of mini combustors 334*b* similarly angled to the mini combustors 134 of FIG. 5 where a radial line forms a fifth combustor angle $\theta_5$ with the secondary centerline CL2 in the transverse plane TP. The fifth combustor angle $\theta_5$ is measured from the secondary centerline CL2 in a clockwise direction CW to the radial line R. While the set of secondary combustors 350 illustrated are a combination of mini combustors 34 of FIGS. 2-4 and mini combustors 134 of FIG. 5, it should be understood that any combination of mini combustors 34, 134, 234 (FIG. 6), 334 (FIG. 7) can define the differently oriented mini combustors 335**.

Further, while combustions section 14 of FIG. 2 is illustrated with eight mini combustors 34 and combustion sections 114, 214, and 314 of FIGS. 5-7 are illustrated with four mini combustors 134, 234, 334, 334*a*, 334*b* respectively, any number of mini combustors at any combustor angle $\alpha$, $\beta$, $\theta_3$, $\theta_4$, $\theta_5$ described herein is contemplated. The number of mini combustors and angle of orientation can be tuned to achieve sufficient mixing between the two exhaust gasses G1, G2.

A method for controlling nitrogen oxides present within the combustion sections 14, 114, 214, 314 described in FIGS. 2-7 includes generating the primary exhaust gasses G1 in the primary combustion chamber 46, 146, 246, 346 and generating secondary exhaust gasses G2 in the set of secondary combustors 50, 150, 250, 350 including the secondary combustion chamber 54, 154, 254, 354. The method further includes injecting the secondary exhaust gasses G2 into the main combustion zone 94 of the primary combustion chamber 46, 146, 246, 346. By not including dilution holes in the main combustion zone 94, the method further includes starving the main combustion zone 94 from $O_2$.

The method can further include flowing the compressed air C into the primary combustion chamber 46, 146, 246, 346 and the secondary combustion chamber 54, 154, 254, 354. Wherein flowing the compressed air C includes receiving 60% to 90% of the compressed air C in the primary combustion chamber 46, 146, 246, 346 and receiving 10% to 40% of the compressed air C in the at least one secondary combustion chamber 54, 154, 254, 354. The method can further include starting the turbine engine 10 with the set of secondary combustors 50, 150, 250, 350.

Benefits associated with the set of secondary combustors in combination with the primary combustor and methods described herein are to reduce $NO_x$ emissions even in a severe cycle with a higher operating air pressure, higher temperature, higher fuel/air ratio and with heated fuel. Typically, higher fuel/air ratio within a combustion system leads to a higher flame temperature which results in higher $NO_x$. By having two combustion chambers within the combustion system, fuel can be split between these chambers thereby reducing the fuel/air ratio in each chamber and in turn achieving lower temperature and hence lower $NO_x$ emission. By directing product of combustion from a secondary combustion into a primary combustion chamber, $O_2$ levels in the primary combustion chamber can be reduced, further reducing $NO_x$ emission. The combustions section herein can operate with 100% $H_2$ fuel.

While described with respect to a turbine engine, it should be appreciated that the combustor as described herein can be for any engine with a having a combustor that emits $NO_x$. It should be appreciated that application of aspects of the disclosure discussed herein are applicable to engines with propeller sections or fan and booster sections along with turbojets and turbo engines as well.

To the extent not already described, the different features and structures of the various embodiments can be used in combination, or in substitution with each other as desired. That one feature is not illustrated in all of the embodiments is not meant to be construed that it cannot be so illustrated, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to describe aspects of the disclosure described herein, including the best mode, and also to enable any person skilled in the art to practice aspects of the disclosure, including making and using any devices or systems and performing any incorporated methods. The patentable scope of aspects of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects are provided by the subject matter of the following clauses:

A combustion section for a turbine engine, the combustion section comprising a primary combustor liner including an inner liner and an outer liner; a dome wall extending between the inner liner and the outer liner; a dome inlet located in the dome wall; at least one opening located in the outer liner downstream from the dome inlet; a primary combustor having a primary combustion chamber defined at least in part by the inner liner, the outer liner, and the dome wall; and a set of secondary combustors including at least one secondary combustion chamber fluidly coupled to the primary combustion chamber at the at least one opening; wherein the outer liner is free of dilution openings upstream of the at least one opening.

The combustion section of any preceding clause, further comprising a set of dilution openings located in the outer liner downstream from the at least one opening.

The combustion section of any preceding clause, wherein the at least one secondary combustion chamber is directed toward the dome inlet.

The combustion section of any preceding clause, further comprising a mini dome wall radially spaced from the outer liner and further defining the at least one secondary combustion chamber and a mini dome inlet located in the mini dome wall and fluidly coupled to the at least one secondary combustion chamber.

The combustion section of any preceding clause, further comprising a primary fuel injector fluidly coupled to the dome inlet and a mini fuel injector fluidly coupled to the mini dome inlet.

The combustion section of any preceding clause, wherein the dome inlet defines a primary centerline and the mini dome inlet defines a secondary centerline that intersects the primary centerline to define a primary combustor angle $\alpha$.

The combustion section of any preceding clause, wherein the primary combustor angle ranges from 25 degrees to 90 degrees.

The combustion section of any preceding clause, wherein a radial line extending from an engine centerline of the turbine engine intersects with a geometric center of the at least one opening and forms a second combustor angle $\beta$ with the secondary centerline in a radial plane, the secondary combustor angle $\beta$ complementary to the primary combustor angle $\alpha$.

The combustion section of any preceding clause, wherein a radial line extending from the engine centerline intersects with a geometric center of the at least one opening and forms an orientation angle with the secondary centerline in a transverse plane.

The combustion section of any preceding clause, wherein the orientation angle is a first orientation angle measured from the secondary centerline in a clockwise direction to the radial line.

The combustion section of any preceding clause, wherein the orientation angle is a second orientation angle measured from the secondary centerline in a counterclockwise direction to the radial line.

The combustion section of any preceding clause, wherein the primary combustion chamber produces primary exhaust gasses that recirculate in a first direction.

The combustion section of any preceding clause, wherein the at least one secondary combustion chamber produces secondary exhaust gasses that flow into the primary combustion chamber in a second direction different than the first direction.

The combustion section of any preceding clause, wherein the at least one secondary combustion chamber produces secondary exhaust gasses that flow into the primary combustion chamber in a direction the same as the first direction.

The combustion section of any preceding clause, wherein the at least one opening is multiple openings circumferentially spaced about the outer liner and wherein the set of secondary combustors comprises multiple mini combustors fluidly coupled to the primary combustion chamber at a corresponding opening of the multiple openings.

The combustion section of any preceding clause, further comprising a main combustion zone that extends between the dome inlet and a geometric center of the at least one opening a main combustion length.

The combustion section of any preceding clause, wherein the primary combustor extends between the dome inlet and a primary combustor outlet a primary combustor length, and the main combustion length is from 5% to 90% of the primary combustor length, inclusive of endpoints.

The combustion section of any preceding clause, wherein the main combustion zone has a combustion residence time that ranges from 1.0 ms to 12 ms, inclusive of endpoints.

The combustion section of any preceding clause, wherein the at least one secondary combustion chamber has a combustion residence time that ranges from 1.1 ms and 20 ms, inclusive of endpoints.

The combustion section of any preceding clause, wherein the at least one opening is radially aligned with the primary fuel injector.

The combustion section of any preceding clause, further comprising a secondary combustor liner extending from the at least one opening to define a secondary combustor outlet, the secondary combustor liner defining at least a portion of the secondary combustion chamber.

The combustion section of any preceding clause, wherein the at least one opening is multiple openings circumferentially spaced about the outer liner.

The combustion section of any preceding clause, wherein the set of secondary combustors comprises multiple mini combustors fluidly coupled to the primary combustion chamber at the corresponding multiple openings.

The combustion section of any preceding clause, further comprising a primary fuel injector fluidly coupled to the dome inlet.

A turbine engine comprising a compressor section, a combustion section, and a turbine section in serial flow arrangement along an engine centerline, the combustion section comprising: an inner liner circumferentially arranged about the engine centerline; an outer liner spaced radially outward from and concentric with the inner liner; a dome wall extending between the inner liner and the outer liner; a dome inlet located in the dome wall; at least one opening located in the outer liner downstream from the dome inlet; a primary combustor outlet located axially downstream from the dome inlet a primary combustor length and defined by the inner liner and the outer liner; a primary combustor having a primary combustion chamber defined at least in part by the inner liner, the outer liner, and the dome wall and extending between the dome inlet and the primary combustor outlet; and a set of secondary combustors including at least one secondary combustion chamber fluidly coupled to the primary combustion chamber at the at least one opening to define a secondary combustor outlet directed toward the dome inlet; wherein the outer liner is free of dilution openings upstream of the secondary combustor outlet.

The turbine engine of any preceding clause, further comprising a set of dilution openings located in the outer liner downstream from the secondary combustor outlet.

A method for controlling nitrogen oxides present within a combustor of a turbine engine, the method comprising generating primary exhaust gasses in a primary combustion chamber; generating secondary exhaust gasses in a set of secondary combustors including at least one secondary combustion chamber; injecting the secondary exhaust gasses into a main combustion zone of the primary combustion chamber; and starving the main combustion zone from $O_2$.

The method of any preceding clause further comprising flowing compressed air into the primary combustion chamber and the at least one secondary combustion chamber.

The method of any preceding clause wherein flowing the compressed air comprises receiving 60% to 90% of the compressed air in the primary combustion chamber and receiving 10% to 40% of the compressed air in the at least one secondary combustion chamber.

The method of any preceding clause further comprising starting the turbine engine with the set of secondary combustors.

What is claimed is:

1. A combustion section for a turbine engine, the combustion section comprising:

a primary combustor liner including an inner liner and an outer liner;

a dome wall extending between the inner liner and the outer liner;

a dome inlet located in the dome wall, the dome inlet defining a primary centerline;

at least one opening located in the outer liner downstream from the dome inlet;

a primary combustor having a primary fuel injector and a primary combustion chamber defined at least in part by the inner liner, the outer liner, and the dome wall, wherein the primary combustor extends between the dome wall and a primary combustor outlet, and wherein an upstream direction is defined from the primary combustor outlet to the dome inlet; and a set of secondary combustors including at least one secondary combustion chamber fluidly coupled to the primary combustion chamber at the at least one opening, wherein the outer liner is free of dilution openings upstream of the at least one opening, the set of secondary combustors comprising a mini combustor and a mini fuel injector fluidly coupled to a secondary fuel passageway, wherein the mini fuel injector terminates at a mini dome defining a secondary centerline directed towards the dome inlet;

wherein secondary exhaust gasses G2 from the at least one secondary combustion chamber are directed towards the primary combustion chamber, and wherein at least a portion of the secondary exhaust gasses G2 mix with primary exhaust gasses G1 upstream of the at least one opening.

2. The combustion section of claim 1, further comprising a set of dilution openings located in the outer liner downstream from the at least one opening.

3. The combustion section of claim 1, wherein the mini combustor comprises a mini dome wall radially spaced from the outer liner and a mini dome inlet located in the mini dome wall and fluidly coupled to the at least one secondary combustion chamber.

4. The combustion section of claim 3, further comprising a primary fuel injector fluidly coupled to the dome inlet and a mini fuel injector fluidly coupled to the mini dome inlet.

5. The combustion section of claim 3, wherein the mini dome inlet defines the secondary centerline that intersects the primary centerline to define a primary combustor angle $\alpha$.

6. The combustion section of claim 5, wherein the primary combustor angle $\alpha$ ranges from greater than or equal to 25 degrees to less than 90 degrees.

7. The combustion section of claim 6, wherein a radial line extending from an engine centerline of the turbine engine intersects with a geometric center of the at least one opening and forms a second combustor angle $\beta$ with the secondary centerline in a radial plane, the secondary combustor angle $\beta$ complementary to the primary combustor angle $\alpha$.

8. The combustion section of claim 6, wherein a radial line extending from an engine centerline intersects with a geometric center of the at least one opening and forms an orientation angle with the secondary centerline in a transverse plane.

9. The combustion section of claim 8, wherein the orientation angle is a first orientation angle measured from the secondary centerline in a clockwise direction to the radial line.

10. The combustion section of claim 8, wherein the orientation angle is a second orientation angle measured from the secondary centerline in a counterclockwise direction to the radial line.

11. The combustion section of claim 1, wherein the primary combustion chamber produces the primary exhaust gasses G1 that recirculate in a first direction.

12. The combustion section of claim 11, wherein the at least one secondary combustion chamber produces the secondary exhaust gasses G2 that flow into the primary combustion chamber in a second direction different than the first direction.

13. The combustion section of claim 1, wherein the at least one opening is multiple openings circumferentially spaced about the outer liner and wherein the set of secondary combustors comprises multiple mini combustors fluidly coupled to the primary combustion chamber at a corresponding opening of the multiple openings.

14. The combustion section of claim 1, further comprising a main combustion zone that extends between the dome inlet and a geometric center of the at least one opening a main combustion length.

15. The combustion section of claim 14, wherein the primary combustor extends between the dome inlet and a primary combustor outlet a primary combustor length, and the main combustion length is from 5% to 90% of the primary combustor length, inclusive of endpoints.

16. The combustion section of claim 15, wherein the main combustion zone has a combustion residence time that ranges from 1.0 ms to 12 ms, inclusive of endpoints.

17. The combustion section of claim 16, wherein the at least one secondary combustion chamber has a combustion residence time that ranges from 1.1 ms and 20 ms, inclusive of endpoints.

18. A turbine engine comprising:

a compressor section, a combustion section, and a turbine section in serial flow arrangement along an engine centerline, the combustion section comprising:

an inner liner circumferentially arranged about the engine centerline;

an outer liner spaced radially outward from and concentric with the inner liner;

a dome wall extending between the inner liner and the outer liner;

a dome inlet located in the dome wall;

a primary combustor having a primary combustion chamber defined at least in part by the inner liner, the outer liner, and the dome wall and extending between the dome inlet and a primary combustor outlet, wherein the primary combustor outlet is located a primary combustor length from the dome inlet, and wherein an upstream direction is defined from the primary combustor outlet to the dome inlet and a downstream direction from the dome inlet to the primary combustor outlet;

at least one opening located in the outer liner downstream from the dome inlet, wherein the outer liner is free of dilution openings upstream of the at least one opening; and a set of secondary combustors including at least one secondary combustion chamber fluidly coupled to the primary combustion chamber at the at least one opening to define a secondary combustor outlet, the set of secondary combustors comprising a mini combustor and a mini fuel injector fluidly coupled to a secondary fuel passageway, wherein the mini fuel injector terminates at a mini dome inlet defining a secondary centerline directed toward the dome inlet;

wherein secondary exhaust gasses G2 from the mini combustor are directed towards the primary combustion chamber, and wherein at least a portion of the secondary exhaust gasses G2 mix with primary exhaust gasses G1 upstream of the at least one opening.

19. The combustion section of claim 1, further comprising a primary ignitor fluidly coupled to the primary combustion chamber.

20. The combustion section of claim 1, wherein at least one of the primary fuel injector or the mini fuel injector is coupled to a fuel system configured to privide hydrogen ($H_2$) fuel or blends of hydrogen ($H_2$) fuel to the primary fuel injector or the mini fuel injector.

* * * * *